United States Patent [19]

Goodspeed

[11] 4,423,533

[45] Jan. 3, 1984

[54] FURNACE AIR PORT CLEANER

[76] Inventor: Byron L. Goodspeed, 1111 Holcomb Rd., Kelso, Wash. 98626

[21] Appl. No.: 386,535

[22] Filed: Jun. 9, 1982

[51] Int. Cl.[3] ..... D21C 7/14

[52] U.S. Cl. ..... 15/246; 162/48; 266/269

[58] Field of Search ..... 15/93 R, 246; 266/269; 162/48

[56] References Cited

U.S. PATENT DOCUMENTS 3,397,110 8/1968 Rosenblad ..... 162/48 X 4,353,530 10/1982 Iyama et al. ..... 266/269 X

*Primary Examiner*—Chris K. Moore

[57] ABSTRACT

Apparatus for cleaning air ports in a chemical recovery furnace includes a face plate removably received in a frame secured to the outer wall of the wind box associated with the furnace. The face plate pivotally carries a plurality of tubes which sealingly receive rods adapted to slide in the tubes toward and away from the air ports on the interior furnace or firebox wall. An actuating cylinder moves the rods toward the air port openings, while a reciprocating mechanism rotates the aforementioned tubes causing cleaning tips on the rod ends to enter the air port openings and clean char buildup along the edges thereof.

14 Claims, 8 Drawing Figures

FURNACE AIR PORT CLEANER

BACKGROUND OF THE INVENTION

The present invention relates to apparatus for cleaning air port openings in a firebox and particularly to such apparatus for thoroughly, quickly and automatically cleaning said openings.

Pulp for papermaking is usually manufactured according to the kraft or sulfate process wherein wood chips are treated with a cooking liquor including sodium sulfide and sodium hydroxide. The wood chips and liquor are cooked in a digester under predetermined heat and temperature conditions. At a subsequent point in the process, a "black liquor", comprising spent chemicals and organic material separated from the pulp, is treated in a recovery unit for reclaiming the cooking chemicals. Without this reclamation and reuse of cooking chemicals, the cost of the papermaking process would be prohibitive. The "black liquor" is sprayed into the firebox of the recovery furnace wherein organic material burns at a high temperature, and wherein the chemicals are deposited on the floor of the firebox as a char bed from which a molten chemical-containing smelt is recovered for further treatment. At the same time, combustion heat is employed to generate steam in a boiler for generation of electricity and/or for use as process steam.

In the recovery furnace air is forced into the furnace firebox through a multiplicity of air ports from a wind box disposed in surrounding relation to the firebox. However, the black liquor tends to form char deposit buildup around the edges of the air ports, which deposit blocks off air flow. According to customary practice, the char buildup at the air ports is periodically removed by a workman in a somewhat inefficient and unsafe manner. Alternate cleaning of the air ports and gradual closing off of the air ports by char buildup in this way causes large changes in the volume of combustion air, as well as changes in air distribution, velocity and pressure. Furnace operation tends to be inefficient and unpredictable with a resultant decrease in the amount of chemicals that can be recovered and a decrease in the amount of steam produced per pound of fuel.

Mechanical lances are also known for perforating the buildup, after which air flow is relied upon to clean the openings. However, cleaning in this manner is frequently inefficient and incomplete.

SUMMARY OF THE INVENTION

According to the present invention, in a preferred embodiment thereof, furnace air ports are cleaned automatically by apparatus comprising a plurality of rods each provided with a cleaning tip adapted for insertion into one of the air port openings. These cleaning tips are smaller than the openings in at least one lateral direction. For example, the air port openings may be elongated in a vertical direction, in which case the cleaning tips are suitably adapted to extend predominently crossways of the respective air port openings. Means are provided for advancing the rods in a direction primarily longitudinal thereof for inserting the cleaning tips into the air port openings, and for subsequently retracting the rods for retracting the cleaning tips after cleaning has been accomplished. Means also move the said rods in at least said one lateral direction, e.g. in the vertical direction in the case where the air port openings are longer in that direction. Thus, the cleaning tips are moved along edges of the air port openings to dislodge combustion products or char buildup therefrom.

In a particular embodiment, mounting means are provided for removable attachment to the outer wall of a wind box, wherein said rods extend through said wind box in substantial alignment with air port openings in the firebox. The mounting means pivotally and slidably mount the aforementioned rods and preferably include lined tubes for slidably receiving the rods, fulcrum blocks through which said tubes extend, bearing means for rotatably supporting said fulcrum blocks, and sealing plates disposed between the fulcrum blocks and the wall of the wind box, said sealing plates having apertures for receiving said tubes in substantially sealing relation. The rods are advanced in a direction primarily longitudinal thereof by means of an actuating cylinder disposed between the aforesaid mounting means and a cross member joining the rods exteriorly of the wind box. The means for moving said rods in at least said one lateral direction, e.g. vertically in the case of vertically elongated air port openings, desirably comprise means for pivoting said rods relative to the mounting means, and in particular a cross arm attached to said tubes and motor means for reciprocally driving said cross arm.

The apparatus according to the present invention is suitably operated at regular intervals on an automatically timed basis so as to keep the air port openings substantially clear. As a consequence, a better recovery of chemicals can be achieved as well as a more efficient conversion of heat energy to steam or the like. While only one apparatus unit according to the present invention is illustrated and described herein, it will be understood that a plurality of such units are ordinarily disposed around a particular firebox so as to clean a comparatively large number of air port openings. The separate apparatus units can be operated simultaneously or sequentially.

The apparatus according to the present invention is easily removable from and adjustable with respect to the recovery furnace. In particular, the apparatus is mounted on the external wall of the wind box, with the aforementioned rods extending in alignment with the air port openings in the firebox. For repair or servicing, or in the event of an overflow of liquor through the air port openings, the apparatus according to the present invention is easily removed. The location where the apparatus was attached can then be cleaned and the apparatus replaced without damaging the cleaning apparatus itself.

It is accordingly an object of the present invention to provide an improved apparatus for cleaning air port openings in a firebox, and for providing a safer environment.

It is another object of the present invention to provide an improved air port cleaning apparatus which is easily removable from and easily adjustable with respect to a recovery furnace.

It is a further object of the present invention to provide improved apparatus for enhancing the efficiency of chemical recovery and the efficiency of heat generation in a recovery furnace associated with a paper pulpmaking process.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

DETAILED DESCRIPTION

Figure 1:
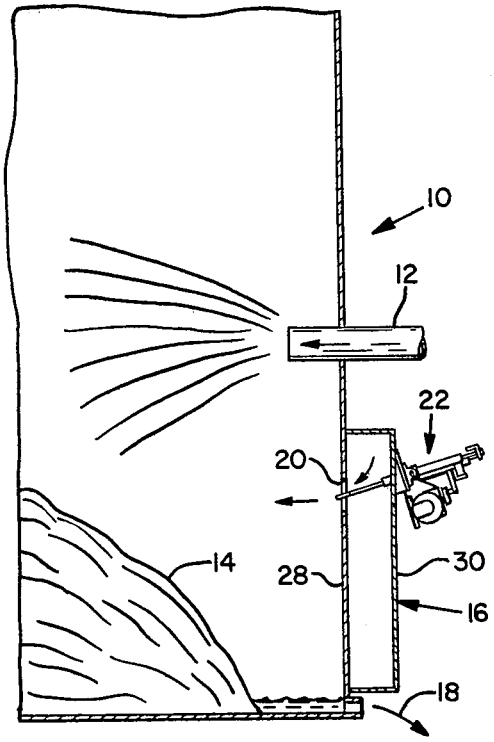
FIG. 1 is a schematic view of a portion of a chemical recovery furnace with which the present invention is employed.

Referring to the drawings and particularly to FIG. 1, the present invention is adapted for use in connection with a recovery furnace 10 which comprises the firebox for a steam boiler. "Black liquor", as hereinabove described, is sprayed into the firebox via conduit 12, with the chemicals being deposited on the floor of the firebox as a char bed 14 from which a molten chemical-containing smelt 18 is recovered for further treatment. A wind box 16 substantially surrounds the firebox and delivers combustion air under pressure into the firebox through a multiplicity of air port openings 20 in wall 28 of the firebox.

In accordance with the present invention, apparatus 22 for cleaning the air port openings is attached to the outer wall 30 of the wind box, and is adapted to clean the air port openings 20 in the wall 28 of the firebox.

Figure 3:
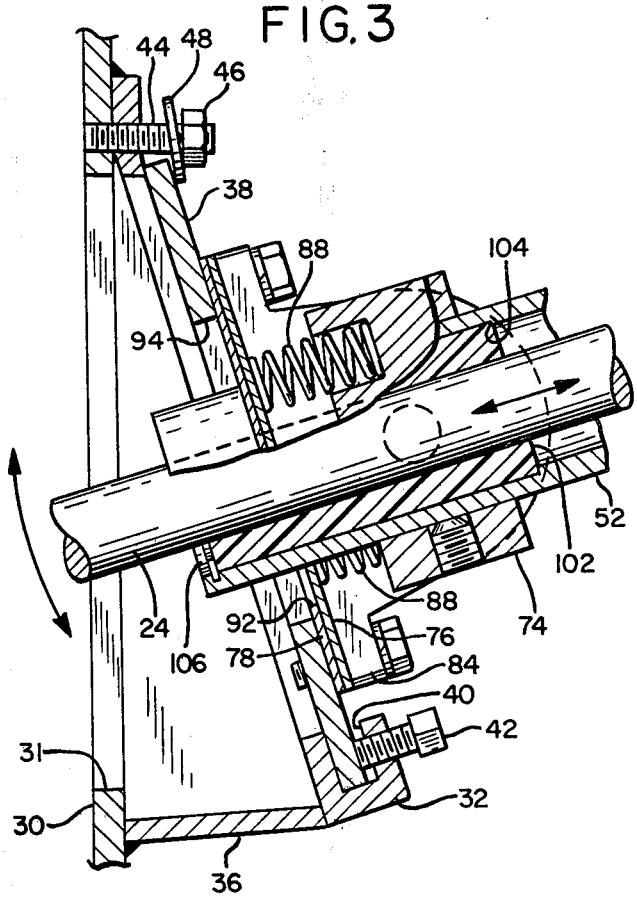
FIG. 3 is a longitudinal cross section of apparatus according to the present invention as taken at 3—3 in FIG. 2.
Figure 2:
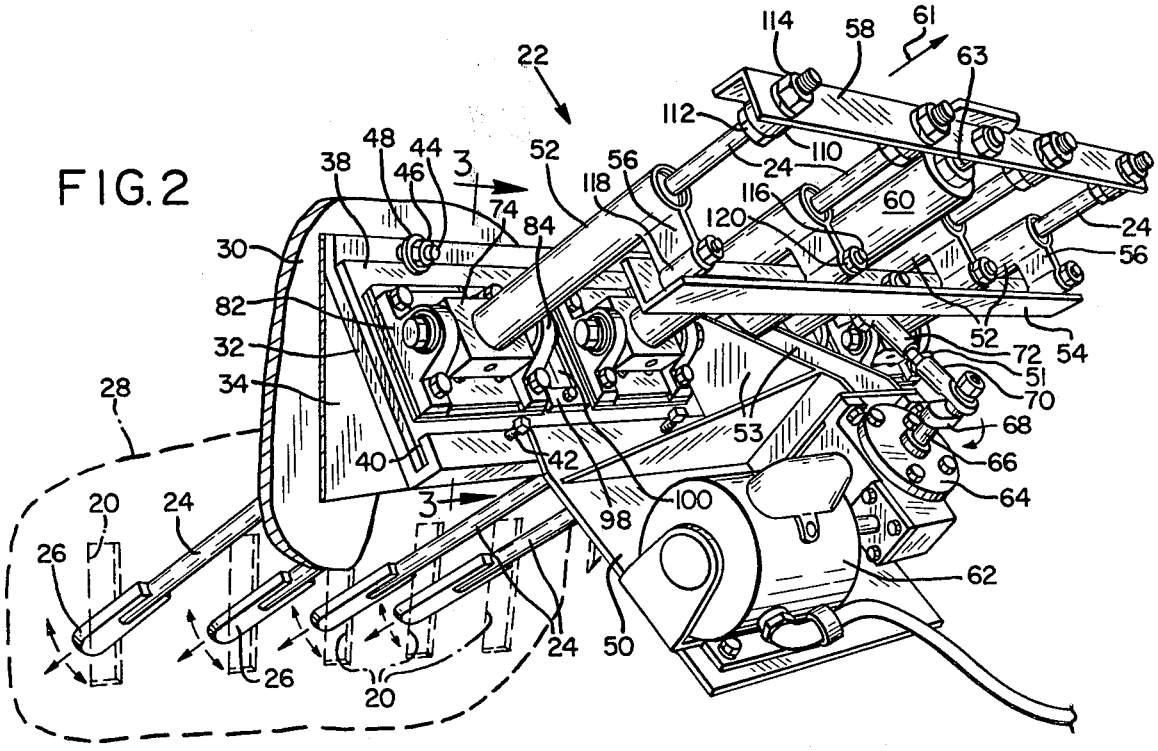
FIG. 2 is a perspective view of apparatus according to the present invention.
Figure 4:
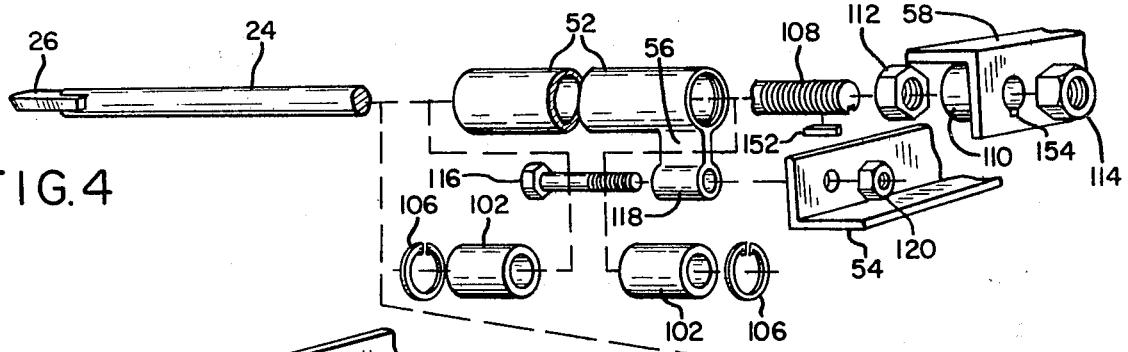
FIG. 4 is an exploded view of a portion of the FIG. 2 apparatus.

Referring now to FIGS. 2, 3 and 4, illustrating apparatus 22 in greater detail, the apparatus comprises a plurality of rods 24 each provided with a cleaning tip 26 adapted for insertion into one of the air port openings 20 in the firebox wall. The apparatus described herein comprises four such rods with a cleaning tip on the forward end of each rod, but it is understood a greater or lesser number of rods could have been included in each unit. The unit as disclosed is conveniently manageable, and can be easily removed and transported from the furnace in the event access is required to the interior of the wind box. The rods 24 are suitably formed from stainless steel, while the cleaning tips 26 are suitably formed from stainless steel comprising a chromium molybdenum alloy No. 4140. Alternatively a high nickel alloy steel may be employed, but in any case the material should be such that the forward end of the tip can withstand the high temperatures of the firebox (typically 1,700° F.) for short periods. In a particular embodiment, the cleaning tips extended crossways of the corresponding air port opening 20, being approximately one and one-fourth inches in width with a rounded end. The cleaning tips were relatively narrow in vertical cross section, being approximately equal in height to the diameter of the corresponding rod 24 to which a tip is welded, with the rearward end of the tip being bifurcated to receive the rod as illustrated. It will thus be seen that the cleaning tip height is substantially smaller than the long distance or height of the air port opening 20 into which the tip is adapted to extend. Therefore, as hereinafter more fully explained, the tip is movable in a vertical direction for cleaning along the edges of the corresponding air port opening for disloding the char buildup therefrom.

Mounting means are provided for removable attachment to the outer wall of the wind box for pivotally and slidably mounting the rods 24. The mounting means comprises a face plate 38 received in a frame 32 covering an opening 31 in the front of the wind box. The frame 32 is disposed at an angle such that the rods 24 suitably extend angularly downwardly toward the air port openings 20. The upper edge of the frame 32 is suitably welded directly to wind box wall 30, while side walls 34 and lower wall 36 extend such opening outwardly whereby the lower forward edge of frame 32 is spaced outwardly from the wall 30 of the wind box. The frame 32 includes a lower groove 40 along which face plate 38 is adapted to slide in positioning the rods 24 in matching juxtaposition with the air port openings. In securing the face plate to the wind box, the lower edge of the face plate is locked in place by means of set screws 42, while nuts 46 secured on studs 44 extending from the upper edge of the wind box opening are adapted to secure the upper edge of face plate 38 between washers 48 and the frame 32. It will be seen the face plate carrying the entire apparatus is readily adjustable, and is readily removable from the outer wall of the wind box of the furnace.

The mounting means further comprises a plurality of fulcrum blocks 74 pivotable about a horizontal axis between bearing pillow blocks 82 and 84. A bolt 86 is received through the bearing into a threaded hole in the fulcrum block on each end thereof. Each fulcrum block is centrally provided with a bore 53 for receiving a tube 52 within which a rod 24 is slidably carried. Set screws secure each tube 52 in a desired position so that it suitably extends no farther than just within the wind box. Thus, a tube 52 is pivotable with fulcrum block 74 about the axis of bolts 86.

The bearing pillow blocks 82 and 84 are bolted to the face plate 38, in each case through a bearing support and sealing plate retainer 78 having a vertically elongated, oval opening 92 for receiving a tube 52. The face plate 38 is also provided with a vertically elongated opening 94 through which the tube 52 extends. The retainer 78 is centrally thinner to provide a track 80 within which a sealing plate 76 is slidable. Sealing plate 76 has a central, substantially circular aperture 90 which receives the tube 52, with the sealing plate 76 sliding along track 80 as the tube 52 pivots with fulcrum block 74. This construction provides a movable seal at the forward end of the wind box to prevent undue escape of air under pressure. A plurality of springs 88 are disposed between the forward side of sealing plate 76 and depressions in the rearward side of fulcrum block 74 so as to retain the sealing plate 76 along track 80.

Within each end of each tube 52 is inserted a teflon bushing 102 held in position between an inner shoulder 104 of a tube 52 and a retaining ring 106 located in a groove at the end of the tube. The teflon bushings are adapted to slidably receive the rod 24 in air sealing relation and are also suitable for withstanding comparatively high temperatures inasmuch as the rod as well as the bushings will be subjected to heat in the wind box. In addition, the rod will conduct heat when the cleaning tip carried thereby is inserted into the higher temperature firebox.

The tube 52 suitably comprises stainless steel pipe having a longitudinal fin 56 welded to the lower forward end thereof. To the lower end of the fin is welded a smaller pipe 118 adapted to receive bolt 116 which is secured with nut 120 to cross arm 54 comprising a steel angle. Cross arm 54 comprises means for pivoting a rod 24 in conjunction with motor 62 and the intervening drive linkage. It will be seen each of the tubes 52 is secured to cross arm 54 in like manner, while an adjustable linkage arm comprising internally threaded members 70 and 72 is pivotally connected to the center of cross arm 54. The internally threaded members 70 and 72 receive a common externally threaded member which is suitably locked against one of the internally threaded members by a nut 51 after the linkage arm is adjusted for length to position the up and down throw of the cleaning tips 26. The remaining end of the linkage arm 70–72 is pivotally and removably connected to eccentric crank arm 68 attached to the outward end of shaft 66 of gear reducer 64 driven by motor 62. Operation of motor 62 causes shaft 66 to rotate, bringing about reciprocation of cross arm 54 and therefore pivoting action of rods 24. The amount of eccentricity can be adjustable.

Motor 62 as well as gear reducer 64 are mounted upon support bracket 50 which is welded to face plate 38. Therefore, the whole unit including the motor drive is readily removable from the furance, as by loosening the aforementioned set screws 42 and nuts 44.

The outer end of each rod 24 is threaded as indicated at 108, and is secured by means of nuts 112 and 114 to cross member 58 suitably comprising a steel angle inverted in position from cross arm 54. The lower edge of threaded portion 108 is slotted to receive a key 152 also received in a keyway 154 in cross member 58 and locking collar 110 rearwardly secured to cross member 58. Thus, the rod is prevented from turning such that cleaning tip 26 is maintained with the desired orientation, i.e. crossways of the shorter dimension of the particular air port opening. The rod 24 is longitudinally positionable to an extent by adjusting nuts 112 and 114 to given positions along the thread before the nuts are tightened to secure the rod to cross member 58.

Means for slidably advancing the rods in a longitudinal direction toward the air port openings comprises an actuating cylinder, preferably an air operated cylinder, 60, the actuating rod 63 of which is centrally joined to cross member 58. The remaining end of actuating cylinder 60 is pivotally attached to face plate 38, and particularly between flanges 53 of bracket 50. It will be seen that operation of actuating cylinder 60 in the direction indicated by arrow 61 in FIG. 2 will withdraw the rods so as to remove cleaning tips 26 from air ports 20, while operation of the cylinder 60 in the opposite direction inserts the cleaning tips into the air port openings as shown.

For the purpose of observing the interior of the wind box, viewing windows are provided. A frame 98 is secured to face plate 38 over rectangular opening 96 and secures pyrex glass plate 100 over the opening.

The apparatus according to the present invention in the at-rest-position will have the operating rod 61 of actuating cylinder 60 extended such that cleaning tips 26 are normally withdrawn from air port openings 20. It will be observed that the temperature in the firebox is normally much hotter than in the wind box where the cleaning tips normally reside and consequently the tips are protected to a degree from the excessive temperature of the firebox except for a brief period of use. Also, the cleaning tips are withdrawn to prevent blocking the air passage into the firebox through openings 20. At timed intervals, e.g. about every twenty minutes, the actuating cylinder 60 is operated for advancing the rods for inserting the cleaning tips 26 into openings 20. Then, while the rods are thus extended, motor 62 is operated for oscillating the structure including cross arm 54 and tubes 52 up and down at about one cycle per second. The rods are pivoted to cause up and down movement of the cleaning tips 26 along the openings for removing char deposits from the edges of the openings and providing a clear passage of air into the firebox. The oscillating up and down movement has been found to be quite successful in removing the undesired blockage. Immediately after a short interval of up and down movement, e.g. after about ten to fifteen seconds, the operation of motor 62 is discontinued and actuating cylinder 60 is again operated for retracting the cleaning tips from the firebox back to their original positions.

Figure 5:
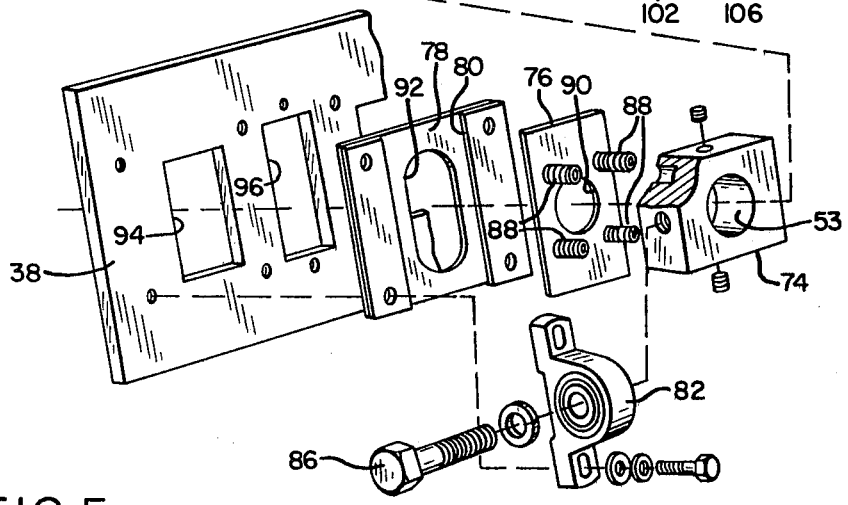
FIG. 5 is an exploded view of alternative mounting means according to the present invention.
Figure 6:
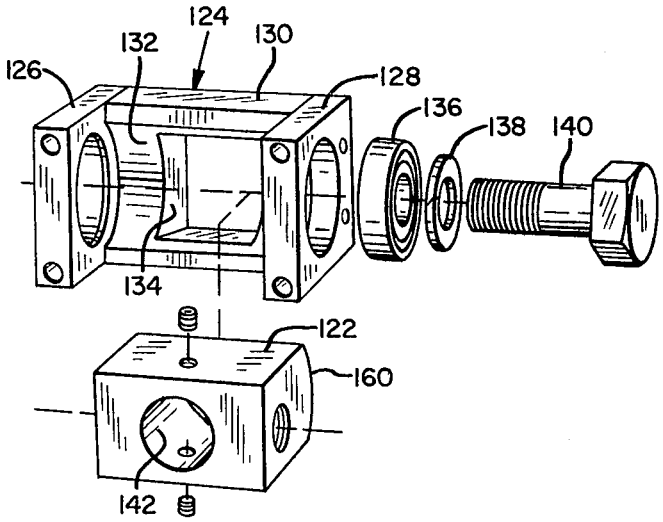
FIG. 6 is a transverse cross section of the FIG. 5 apparatus.

FIGS. 5 and 6 illustrate alternative mounting means 124 for pivotally and slidably mounting a rod 24. Included is a fulcrum block 122 adapted to be substituted for fulcrum block 74 in the above-described embodiment, said fulcrum block having a bore 142 for receiving and supporting a tube 52'. The structure comprising end pieces 126 and 128 in FIG. 5 substitutes for the pillow block bearings 82 and 84 in the previously described embodiment. A said end piece is adapted to receive a bearing 136 through which a bolt 140 extends for threadable engagement in an end of fulcrum block 122. A lock washer 138 is suitably disposed between the head of bolt 140 and bearing 136. A back bearing member 130, extending between and integral with end pieces 126 and 128 and adapted for placement in secured relation against face plate 38, includes a forward cylindrically curved surface 132 for substantially matching a cylindrically curved rear surface 160 of fulcrum block 122. As illustrated in FIG. 6, these surfaces are positioned substantially in slidable relation, while tube 52' extends through large opening 134 in back bearing member 130. This construction provides an effective air seal for substantially preventing the escape of air from the wind box while allowing pivoting motion of tube 52'. The construction of FIGS. 5 and 6 eliminates the necessity for the slidable sealing plate 76 of the previous embodiment.

Figure 7:
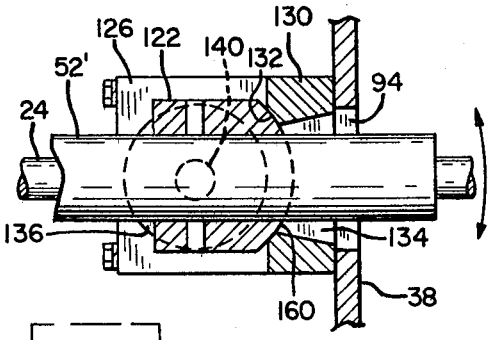
FIG. 7 is a longitudinal cross section of an alternative cleaning tip suitable for use of the apparatus of the present invention.
Figure 8:
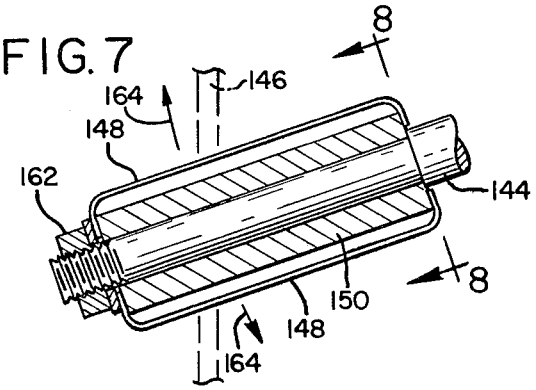
FIG. 8 is a transverse cross-sectional view of the FIG. 7 tip.
Figure 8:
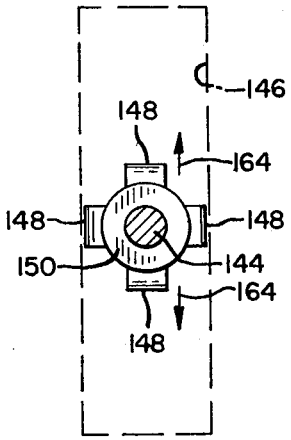

FIGS. 7 and 8 illustrate an alternative cleaning tip as may be employed with the present invention. Extensible rod 144, corresponding to a rod 24 of the previous embodiment, slidably receives a tubular member 150 at the lower end thereof whereby the tubular member is rotatable on the rod. Tubular member 150 carries several longitudinally oriented metal strips 148 which are secured to ends of tubular member 150, and which bow outwardly in spring fashion to contact the edges of an air port opening as indicated at 146. As the rod 144 is moved vertically in the directions indicated by arrows 164, the metal strips 148 will tend to ride along the edges of air port opening 146, or alternatively the tubular member 150 can rotate such that one metal strip 148 after another will engage the edge of the air port opening. Whether or not the tip rotates will depend somewhat upon the relative size and positioning of the tip in respect to the opening. It will be noted that the face plate 38 is slidable in a horizontal direction with respect to frame 32 so as to position the tips as desired with respect to the air port openings. The tip according to FIGS. 7 and 8 is adapted to provide a scraping or brushing action along the opening edges.

In the embodiment illustrated in FIGS. 7 and 8, the rod 144 is shown threaded on its forward end for receiving a nut 162 whereby to retain the rotatable member 150 on the rod. However, other means such as a detent or the like may be employed for removably securing the rotatable member 150 to rod 144 within the rotatable member 150, or at the end of member 150 farthest from the end which enters the firebox.

Although up and down movement of the cleaning tips is herein illustrated for cleaning air port openings which are elongated in a vertical direction, it will be apparent that the pivotal mounting means for each rod can be turned ninety degrees for moving cleaning tips in a horizontal direction to clean air port openings which are elongated horizontally. Alternatively, apparatus according to the present invention may provide a component of motion in each of the horizontal and vertical directions, for instance circularly for cleaning around the edge of larger openings. In any case, the cleaning tip executes lateral movement, i.e. in a direction transverse to the longitudinal direction of the rods, for dislodging material. It provides an effective, scrubbing type action relative to the char buildup because of the lateral reciprocating motion.

A number of units of the apparatus according to the present invention are ordinarily installed on a single firebox for the same boiler. The operation of the units are timed by timer means, not shown, to be substantially completely automatic for inserting the rods periodically for quickly cleaning the air ports during furnace operation. After several up and down strokes of the cleaning tips, the rods are automatically retracted again.

In addition to providing improved efficiency in boiler operation, the present invention enhances operating safety, not only in eliminating the necessity of manual cleaning, but also in stabilizing the char bed which reduces the danger of hot spots and boiler tube rupture.

Although according to the illustrated embodiments the rods are moved forwardly to insert the cleaning tips after which the cleaning tips are moved up and down along the air port openings, the motions could be reversed to move the cleaning tips in and out after each incremental portion of an over all up and down motion.

While I have shown and described plural embodiments of my invention, it will be apparent to those skilled in the art that many changes and modifications may be made without departing from my invention in its broader aspects. I therefore intend the appended claims to cover all such changes and modifications as fall with the true spirit and scope of my invention.

I claim:

1. Apparatus for cleaning an opening in a firebox, said apparatus comprising:

a rod provided with a cleaning tip adapted for insertion into said opening, said cleaning tip being smaller than said opening in at least one lateral direction, means for advancing said rod in a direction primarily longitudinal of said rod for inserting said cleaning tip into said opening, and for subsequently retracting said rod for retracting said cleaning tip from said opening, and means for moving said rod in at least said one direction to move said cleaning tip with respect to edges of said opening to dislodge residual buildup therefrom.

2. Apparatus for cleaning air port openings located in a wall of a firebox, said firebox being provided with a wind box for supplying air under pressure to said openings, said wind box having an outer wall spaced from said wall of said firebox, said apparatus comprising:

a plurality of rods each provided with a cleaning tip adapted for insertion into one of said openings, said cleaning tip being smaller than said opening in at least one lateral direction, mounting means for removable attachment to said wind box for pivotally and slidably mounting said rods, means for slidably advancing said rods in a direction primarily longitudinal of said rods for inserting said cleaning tips into said openings, and for subsequently retracting said rods for retracting said cleaning tips from said openings, and means for moving said rods in at least one laterial direction while said cleaning tips are inserted in said openings and before retraction thereof to move said cleaning tips along edges of said openings for dislodging residual buildup therefrom, said means for moving said rods in at least one lateral direction comprising means for pivoting said rods with respect to said mounting means.

3. The apparatus according to claim 2 wherein said mounting means includes plural lined tubes for slidably receiving said rods, and wherein said means for pivoting said rods comprises a cross arm attached to said tubes and motor means for reciprocally driving said cross arm.

4. The apparatus according to claim 2 including a cross member joining said rods on the opposite side of said mounting means from said firebox, and wherein said means for slidably advancing said rods comprises an actuating cylinder disposed between said cross member and said mounting means.

5. The apparatus according to claim 2 wherein said mounting means for pivotally and slidably mounting said rods comprises a lined tube for slidably receiving each said rod, a fulcrum block through which said tube extends, bearing means on either side of said fulcrum block for rotatably supporting said fulcrum block, a face plate for mounting said bearing means, and a laterally slidable sealing plate disposed between said bearing means and between said fulcrum block and said face plate, said sealing plate having an aperture for receiving said tube in substantially sealing relation.

6. The apparatus according to claim 5 further including biasing means disposed between said fulcrum block and said sealing plate for maintaining the lateral orientation of said sealing plate.

7. The apparatus according to claim 5 further including a frame for attachment to the outer wall of the wind box, said frame adjustably and removably receiving said face plate.

8. The apparatus according to claim 2 wherein said mounting means for pivotally and slidably mounting said rods comprises a lined tube for slidably receiving each said rod, a fulcrum block having an aperture through which said tube extends and having a rear cylindrically curved surface, bearing means on either side of said fulcrum block for rotatably supporting said fulcrum block, a face plate for mounting said bearing means, and a back bearing member having a forward cylindrically curved surface mating with the rear cylindrically curved surface of said fulcrum block.

9. The apparatus according to claim 2 wherein said tips are substantially flat in a horizontal plane where they are secured to ends of said rods, said tips having a forwardly curved profile in said horizontal plane.

10. The apparatus according to claim 2 wherein said tips are adapted to touch sides of said openings.

11. The apparatus according to claim 10 wherein said tips comprise flat metal members rotatable on axes longitudinal of said rods.

12. Apparatus for cleaning air port openings located in a wall of a firebox, said firebox being provided with a wind box for supplying air under pressure to said openings, said wind box having an outer wall spaced from said wall of said firebox, said apparatus comprising:

a plurality of rods each provided with a cleaning tip adapted for insertion into one of said openings, mounting means for supporting said rods for movement toward and away from said openings in said wind box, said mounting means comprising a plate member mountable at the exterior wall of said wind box for disposing said rods through an opening in said wind box wall, said rods being removable as a unit together with said mounting means from said wind box, and means attached to said mounting means and removable therewith for reciprocating said rods for insertion of said cleaning tips into said openings.

13. The apparatus according to claim 12 further provided with a frame for substantially permanent attachment to the outer wall of said wind box, said frame removably receiving said plate member.

14. The apparatus according to claim 13 wherein said frame is provided with a lower edge groove in which said plate member rests.

* * * * *